US008771801B2

(12) United States Patent
Moren et al.

(10) Patent No.: US 8,771,801 B2
(45) Date of Patent: Jul. 8, 2014

(54) ELECTROSTATIC ABRASIVE PARTICLE COATING APPARATUS AND METHOD

(75) Inventors: Louis S. Moren, Mahtomedi, MN (US); Brian G. Koethe, Cottage Grove, MN (US); John T. Boden, White Bear Lake, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 13/883,132

(22) PCT Filed: Feb. 6, 2012

(86) PCT No.: PCT/US2012/023916

§ 371 (c)(1), (2), (4) Date: May 2, 2013

(87) PCT Pub. No.: WO2012/112322

PCT Pub. Date: Aug. 23, 2012

(65) Prior Publication Data

US 2013/0312337 A1 Nov. 28, 2013

Related U.S. Application Data

(60) Provisional application No. 61/443,399, filed on Feb. 16, 2011.

(51) Int. Cl.

| | |
|---|---|
| ***B05D 1/04*** | (2006.01) |
| ***B05D 1/06*** | (2006.01) |
| ***B24D 18/00*** | (2006.01) |

(52) U.S. Cl.

USPC ..... 427/474; 427/470; 427/472

(58) Field of Classification Search

USPC ..... 427/470, 472, 474; 51/307

See application file for complete search history.

(56) References Cited

U.S. PATENT DOCUMENTS

| | | | | |
|---|---|---|---|---|
| 2,370,636 | A | | 3/1945 | Carlton |
| 2,970,929 | A | * | 2/1961 | Hansen et al. ..... 51/295 |
| 4,091,764 | A | * | 5/1978 | Brennenstuhl ..... 118/621 |
| 4,901,666 | A | | 2/1990 | Nagasaka |
| 5,161,696 | A | | 11/1992 | Seider |
| 5,201,916 | A | | 4/1993 | Berg |
| 5,372,620 | A | | 12/1994 | Rowse |
| RE35,570 | E | | 7/1997 | Rowenhorst |
| 5,984,998 | A | | 11/1999 | Ottesen |
| 6,475,253 | B2 | | 11/2002 | Culler |
| 6,511,713 | B2 | | 1/2003 | Mathisen |
| 6,752,700 | B2 | | 6/2004 | Duescher |

(Continued)

FOREIGN PATENT DOCUMENTS

| | | |
|---|---|---|
| GB | 378014 | 7/1932 |
| GB | 407978 | 3/1934 |
| GB | 433128 | 8/1935 |
| GB | 457462 | 11/1936 |
| GB | 510328 | 7/1938 |

(Continued)

*Primary Examiner* — Frederick Parker

(74) *Attorney, Agent, or Firm* — Scott A. Baum

(57) ABSTRACT

A method of applying particles to a backing having a make layer on one of the backing's opposed major surfaces. The method including the steps of: supporting the particles on a feeding member having a feeding surface such that the particles settle into one or more layers on the feeding surface; the feeding surface and the backing being arranged in a non-parallel manner; and translating the particles from the feeding surface to the backing and attaching the particles to the make layer by an electrostatic force.

22 Claims, 10 Drawing Sheets

(56) References Cited

U.S. PATENT DOCUMENTS

| | | | |
|---|---|---|---|
| 2002/0142103 | A1 | 10/2002 | Mathisen |
| 2002/0142152 | A1 | 10/2002 | Fredericksen |
| 2003/0059528 | A1 | 3/2003 | Swei |
| 2003/0129302 | A1 | 7/2003 | Chambers |
| 2009/0165394 | A1 | 7/2009 | Culler |
| 2009/0169816 | A1 | 7/2009 | Erickson |
| 2010/0146867 | A1 | 6/2010 | Boden |
| 2010/0151195 | A1 | 6/2010 | Culler |
| 2010/0151196 | A1 | 6/2010 | Adefris |
| 2010/0151201 | A1 | 6/2010 | Erickson |

FOREIGN PATENT DOCUMENTS

| | | | |
|---|---|---|---|
| GB | 518833 | | 3/1940 |
| GB | 523813 | | 7/1940 |
| GB | 555010 | | 7/1943 |
| GB | 564733 | | 10/1944 |
| GB | 571537 | | 8/1945 |
| GB | 587473 | * | 4/1947 |
| GB | 611240 | | 10/1948 |
| PL | 157839 | | 7/1992 |
| PL | 158429 | | 9/1992 |
| WO | WO 01/76769 | | 10/2001 |

* cited by examiner

ELECTROSTATIC ABRASIVE PARTICLE COATING APPARATUS AND METHOD

CROSS REFERENCE TO RELATED APPLICATIONS

This application is a national stage filing under 35 U.S.C. 371 of PCT/US2012/023916, filed Feb. 6, 2012, which claims priority to U.S. Provisional Patent Application No. 61/443,399, filed Feb. 16, 2011, the disclosures of which are incorporated by reference in their entirety herein.

BACKGROUND

The use of an electrostatic field to apply abrasive grains to a coated backing of an abrasive article is well known. For example, U.S. Pat. No. 2,370,636 issued to Minnesota Mining and Manufacturing Company in 1945 discloses the use of an electrostatic field for affecting the orientation of abrasive grains such that each abrasive grain's elongated dimension is substantially erect (standing up) with respect to the backing's surface.

SUMMARY

In conventional electrostatic systems, abrasive particles can be applied to coated backings by conveying the abrasive particles horizontally under the coated backing traveling parallel to and above the abrasive particles on the conveyer belt. The conveyor belt and coated backing pass through a region that is electrostatically charged by a bottom plate connected to a voltage potential and a grounded upper plate. The abrasive particles then travel substantially vertically under the force of the electrostatic field and against gravity attaching to the coated backing and achieving an erect orientation with respect to the coated backing. A significant number of the abrasive particles align their longitudinal axis parallel to the electrostatic field prior to attaching to the coated backing In general, such a configuration works well and has become the industry standard. However, when the abrasive particle becomes too heavy, often expensive abrasive particle coatings are added to enhance the abrasive particle's electrostatic attraction thereby improving the uniformity of the resulting coated abrasive article. During periods of low relative humidity, additional humidification equipment is often needed for the conventional systems to work reliably. Very heavy abrasive particles greater in physical size than about ANSI 20 grit cannot be applied by the current electrostatic technique and must be drop coated onto the coated backing Drop coating results in few abrasive particles having an elongated orientation reducing the abrasive action of the resulting coated abrasive article. The abrasive particles in the conventional system often bounce repeatedly back and forth between the conveyor belt and the coated backing until becoming attached to the coated backing reducing uniformity of the coated abrasive layer.

The inventors have determined that the above problems and additional advantages, including the ability to easily pattern the abrasive coating, can be provided by a new electrostatic coating process where the abrasive particle is propelled in a non-vertical direction, such as substantially horizontally, into the coated backing instead of lifted vertically overcoming the gravitational force. In one embodiment, the coated backing is traveling substantially vertically as the abrasive particles are applied to it. Instead of supporting the abrasive particles on a conveyor belt, the abrasive particles are moved by a vibratory feeder having a feeding tray with at least a portion of the feeding tray connected to a voltage potential generating an electrostatic field. In one embodiment, a ground rod is positioned behind the coated backing opposite the end of the feeding tray. The abrasive particles move horizontally down the length of the feeding tray in a feeding direction under the action of the tray's vibration and the electrostatic field. Thereafter the particles are translated by the electrostatic field from the feeding tray and onto the coated backing. The inventors have found that the new method still results in an elongated orientation of the abrasive particles even though the abrasive particles are traveling horizontally instead of vertically.

Because less gravitational force has to be overcome by the abrasive particles to attach to the coated backing in the new electrostatic system, much lower voltages can be used to create the electrostatic field for a given abrasive particle size. Additionally, because less gravitational force has to be overcome and a vibratory feeding tray is used, much heavier abrasive particles can be applied and/or exterior coatings on the abrasive particles to enhance their electrostatic attraction can be eliminated. The new electrostatic system is also operable in low humidity environments without the need for supplemental humidification.

Furthermore, the inventors have surprisingly found the z-direction rotational orientation of particles in the coated abrasive article can be varied by changing the gap between the end of the feeding tray and coated backing and/or the conductive member. When the gap is less than ⅜", triangular shaped abrasive particles tend to orient more frequently with the triangle's base aligned in the machine direction of the coated backing as it traverses past the feeding tray. When the gap is greater than ⅜", triangular shaped abrasive particles tend to orient more frequently with the triangle's base aligned in the cross machine direction of the coated backing as it traverses past the feeding tray. Selective Z-direction rotational orientation of shaped abrasive particles about their longitudinal axis passing through the backing in an coated abrasive article can be used to enhance grinding rates, reduce abrasive particle breakage, or improve the resulting finish produced by the coated abrasive article. Not only can the new electrostatic system erectly apply shaped abrasive particles, but it can also vary their z-direction rotational orientation which was previously not possible.

The new electrostatic system can also be used to produce coated abrasive articles having a patterned abrasive layer without the use of a mask or a patterned make layer. Cross machine direction abrasive stripes in the coated abrasive article can be easily made by rapidly cycling the voltage applied to the vibratory feeder, the electrostatic field, or both. When the electrostatic field is eliminated, unsupported abrasive particles in the air drop under the gravitational force and are not applied to the coated backing. When the feeding tray vibration is reduced or eliminated, abrasive particles are not applied to the coated backing. Machine direction abrasive stripes on the coated abrasive article can be made by placing discrete channels in the feeding tray such that abrasive particles are only applied at specific cross machine direction locations in the feeding tray. Checkerboard abrasive patterns can be created by using discrete channels and rapidly cycling the electrostatic field. Lines, curves or other patterns can be applied by attaching the feeding tray or the entire vibratory feeder to a positioning mechanism to direct a moving stream of abrasive particles in the X, Y, or Z direction or combinations thereof.

Simultaneous double-sided abrasive particles can be applied by the new electrostatic method. In this method, the coated backing with a make layer on both sides is traversed vertically through a gap between two vibratory feeders each having an electrostatically charged feeding tray. The feeding trays of the two vibratory feeders are opposed to each other. One feeding tray is connected to a positive potential and the other feeding tray is connected to a negative potential. The abrasive particles in each tray are propelled towards the opposing tray and attach to opposites sides of the coated backing.

In some embodiments instead of traversing a coated backing in the machine direction past the charged feeding tray, a coated backing can be attached to a rotating circular disk located near the discharge of the feeding tray. At least a portion of the feeding tray is charged and a grounded ground target is set at a desired gap. The disc is rotated in the presence of the established electrostatic field. The gap between the coated backing on the rotating circular disk and the feeding tray, along with the rotational velocity of the rotating circular disk, can be varied to change the z-direction rotational orientation of shaped abrasive particles applied to the coated backing Hence, in one embodiment, the invention resides in a method of applying particles to a backing having a make layer on one of the backing's opposed major surfaces comprising: supporting the particles on a feeding member having a feeding surface such that the particles settle into one or more layers on the feeding surface; the feeding surface and the backing being arranged in a non-parallel manner; and translating the particles from the feeding surface to the backing and attaching the particles to the make layer by an electrostatic force.

In another embodiment, the invention resides in a method of varying a z-direction rotational orientation of formed abrasive particles in a coated abrasive article comprising: providing formed abrasive particles each having at least one substantially planar particle surface; supplying the formed abrasive particles onto a feeding surface; guiding a backing having a make layer on one of the backing's opposed major surfaces along a web path between the feeding surface and a conductive member such that the make layer faces the feeding surface; creating an electrostatic field between the feeding surface and the conductive member; translating the formed abrasive particles by the electrostatic field from the feeding surface onto the make layer to form the coated abrasive article; and adjusting a gap between the feeding surface and the conductive member to vary the z-direction rotational orientation of the formed abrasive particles on the backing In another embodiment, the invention resides in a method of erectly applying abrasive particles to a make layer of a backing comprising: selecting abrasive particles having an ANSI grit size less than 20 or a FEPA grit size less than P20; supplying the selected abrasive particles onto a feeding surface; guiding a backing having a make layer on one of the backing's opposed major surfaces along a web path between the feeding surface and a conductive member such that the make layer faces the feeding surface; creating an electrostatic field between the feeding surface and the conductive member; translating the selected abrasive particles in a non-vertical direction from the feeding surface onto the make layer to erectly apply the selected abrasive particles to the make layer.

In another embodiment, the invention resides in, an apparatus comprising: a vibratory feeder having a feeding surface; a conductive member opposing the feeding surface; a voltage potential charging the feeding surface generating an electrostatic field between the feeding surface and the conductive member; and a web path for guiding a web between the feeding surface and the conductive member.

BRIEF DESCRIPTION OF THE DRAWINGS

It is to be understood by one of ordinary skill in the art that the present discussion is a description of exemplary embodiments only, and is not intended as limiting the broader aspects of the present disclosure, which broader aspects are embodied in the exemplary construction.

Repeated use of reference characters in the specification and drawings is intended to represent the same or analogous features or elements of the disclosure.

Figure 1:
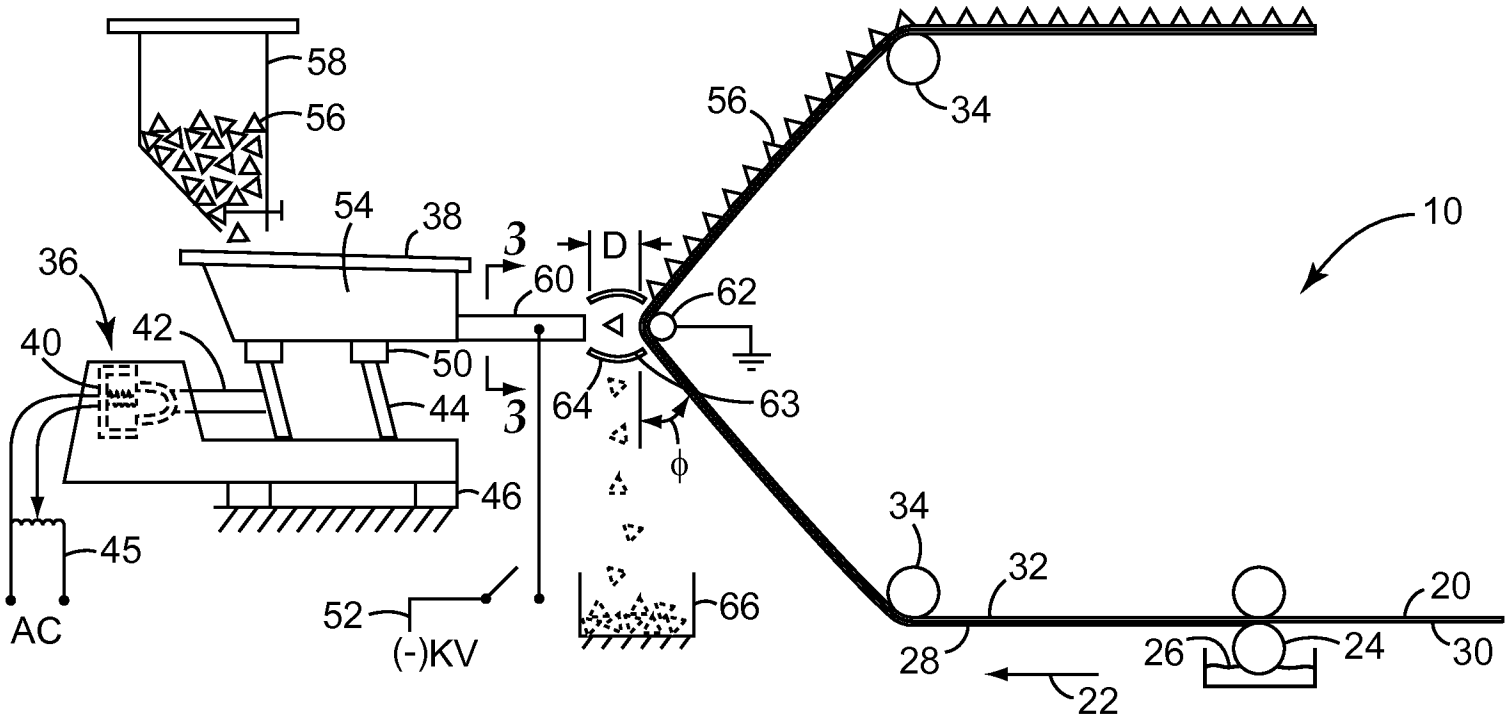
FIG. 1 illustrates an electrostatic system for applying abrasive particles to a coated backing.

Repeated use of reference characters in the specification and drawings is intended to represent the same or analogous features or elements of the disclosure.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein "formed abrasive particle" means an abrasive particle having at least a partially replicated shape. Non-limiting processes to make formed abrasive particles include shaping the precursor abrasive particle in a mold having a predetermined shape, extruding the precursor abrasive particle through an orifice having a predetermined shape, printing the precursor abrasive particle though an opening in a printing screen having a predetermined shape, or embossing the precursor abrasive particle into a predetermined shape or pattern. Non-limiting examples of formed abrasive particles include shaped abrasive particles, such as triangular plates as disclosed in U.S. Pat. Nos. RE 35,570; 5,201,916, and 5,984,998; or elongated ceramic rods/filaments often having a circular cross section produced by Saint-Gobain Abrasives an example of which is disclosed in U.S. Pat. No. 5,372,620; or shaped abrasive composites comprising a binder and plurality of abrasive particles formed into a shape such as a pyramid.

As used herein, "substantially horizontal" means within ±10, ±5, or ±2 degrees of perfectly horizontal.

As used herein, "substantially vertical" means within ±10, ±5, or ±2 degrees of perfectly vertical.

As used herein, "substantially orthogonal" means within ±20, ±10, ±5, or ±2 degrees of 90 degrees.

As used herein, "z-direction rotational orientation" refers to the particle's angular rotation about its longitudinal axis. The longitudinal axis of the particle is aligned with the electrostatic field as the particle is translated through the air by the electrostatic force.

DETAILED DESCRIPTION

Referring now to FIG. 1, a portion of a coated abrasive maker 10 is illustrated. A backing 20 having opposed major surfaces is advanced along a web path 22 past a coater 24 which applies a resin 26 forming a make layer 28 on a first major surface 30 of the backing thereby creating a coated backing 32. The coated backing 32 is guided along the web path 22 by appropriate guide rolls 34 such that the coated backing is traveling substantially vertical as it passes a vibratory feeder 36 acting a feeding member. A conveyor could also act at a feeding member.

The vibratory feeder 36 includes a feeding tray 38 having a feeding surface, and a drive 40 such as an electro-magnetic drive or a mechanical eccentric drive. For an electro-magnetic drive, one end of the armature 42 is connected directly or indirectly to the feeding tray 38 supported by one or more flexible members 44 that permit lateral motion of the tray. A variable AC power supply 45 powers the electro-magnetic drive controlling the amplitude of the vibration transmitted by the armature. The vibratory feeder can be mounted on vibration dampers 46 that provide electrical isolation of the vibratory feeder from earth ground. Alternatively, the feeding tray 38 can be mounted on insulators 50 that provide electrical isolation of the feeding tray from earth ground. Suitable vibratory tray feeders are available from Eriez Manufacturing Co, located in Erie, Pa.

At least a portion of the feeding tray 38 can be electrostatically charged and at least that portion is connected to a positive or negative voltage potential 52 to create an electrostatic field. For example, the feeding tray can comprise a nonconductive receptacle 54 made from an insulating material receiving abrasive particles 56 from hopper 58 and a conductive outlet trough 60 made from a conductive material attached to the non-conductive receptacle 54. While it is possible to electrostatically charge the entire vibratory feeder 36 or just the feeding tray 38, minimizing the surface area charged by the voltage potential makes it easier to isolate the charged surfaces from ground reducing undesirable arcing and enhancing safety. It can also enhance attraction of the abrasive particles to the coated backing by concentrating the electrostatic field. The voltage potential 52 can be rapidly cycled by a switch, PLC, or oscillating circuit to energize and de-energize the electrostatic field.

Figure 2:
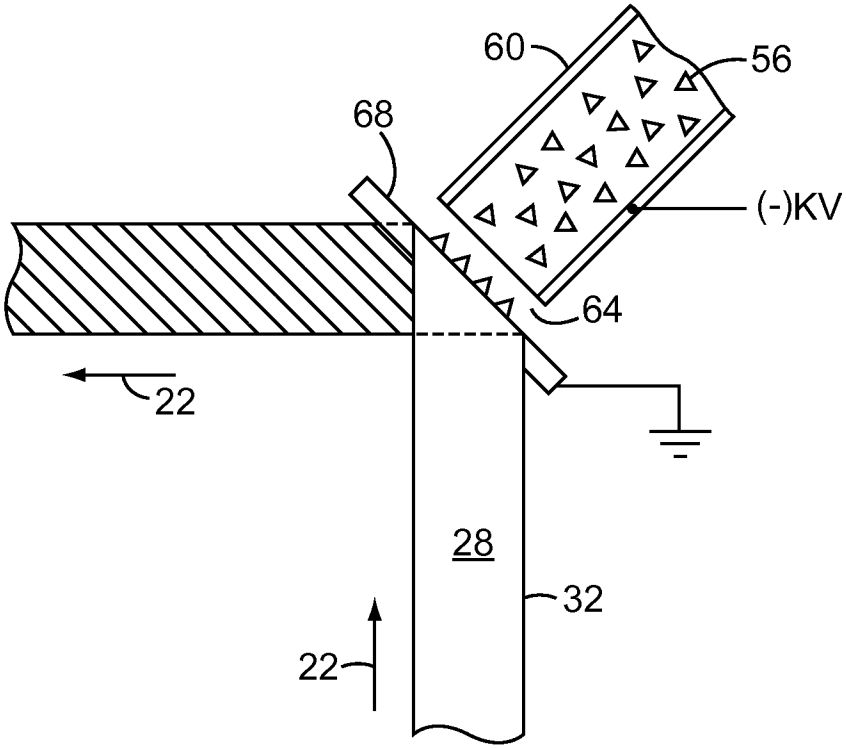
FIG. 2 illustrates a portion of an alternative electrostatic system for applying abrasive particles to a coated backing.

A conductive member 62 such as a metal bar, a spreader bar, an idler roll, a metal plate, a turn bar, or other conductive member is positioned opposite the feeding tray 38 and electrically connected to earth ground in one embodiment. A subset of conductive members have a curved outer surface include, for example, an idler roll, a spreader bar, a turning bar, or a round rod and the coated backing wraps at least a portion of the curved outer surface (FIGS. 1, 2). In other embodiments, the coated web does not touch the conductive member.

The coated backing 32, with the make layer 28 facing the vibratory feeder 36, moves through a gap 64 between the feeding tray 38 and the conductive member 62. An electrostatic field 63 is present in the gap 64 between the charged feeding tray and the conductive member when voltage is applied to the feeding tray 38. Under the action of the vibrator feeder 36, abrasive particles 56 entering the receptacle 54 from the hopper 58 are transported through the feeding tray 38 to the outlet trough 60 acting as a feeding surface and into the gap 64. In the absence of an electrostatic field, the abrasive particles 56 drop vertically under gravitational force into a pan 66 where they can be collected and returned to the hopper 58. Once an electrostatic field is present, the abrasive particles 56 are propelled horizontally across the gap 64 onto the make layer 28 on the backing 20 and become embedded in the make layer. Surprisingly, using a substantially horizontal abrasive particle electrostatic projection method still results in an elongated orientation of the abrasive particles on the backing. It was thought that gravity would tend to tip the abrasive particles after initially hitting the coated backing causing them to "fall over" since in the prior art system, gravity tends to vertically align particles attached to the coated backing. After the abrasive particles are attached to the make layer 28, conventional processing is used to apply a size coat over the abrasive particles and to cure the make and size coats resulting in a coated abrasive article.

The voltage applied to create the electrostatic field can be significantly less with the new electrostatic system since the abrasive particles do not have to overcome as much gravitational force to attach to the coated backing. In particular, in one embodiment, 5-10 kilovolts has been found to adequately apply size 36+ shaped abrasive particles comprising triangular plates whereas a conventional vertically applied electrostatic system required 20-40 kilovolts. Furthermore, ceramic alpha alumina abrasive particles larger in physical size than about ANSI 20 or FEPA P20, such as ANSI 16, ANSI 12, FEPA P16, or FEPA P12, can be readily applied by the new electrostatic system while achieving an erect orientation on the backing. The conventional electrostatic system is unable to apply ceramic alpha alumina abrasive particles of size ANSI 16 grit.

To enhance the electrostatic application, the inventors have determined that the machine direction length of the conductive member 62 and the height of the outlet trough can be relatively short when compared to the size of the electrostatic plates previously used in the conventional systems which are typically 1 foot to 20 feet long in the machine direction. In some embodiments, the conductive member can have a length in the machine direction of less than or equal to 4, 2, 1, 0.75, 0.5, or 0.25 inches. Similarly in some embodiments, the height, H, of the outlet trough at its outlet can have a dimension of less than or equal to 4, 2, 1, 0.75, 0.5, or 0.25 inches. Minimizing the machine direction length of the conductive structures on opposite sides of the gap that create the electrostatic field is believed to concentrate the electrostatic field lines thereby enhancing the uniformity of the resulting coated abrasive layer and possibly helping to rotationally orientate shaped abrasive particles.

The web path 22 at the gap 64 where the abrasive particles are applied in the illustrated embodiment is substantially vertical as the coated web wraps the conductive member 62. The web path 22 prior to applying the abrasive particles is inclined from vertical and away from the vibratory feeder 36 in order to prevent the abrasive particles from contacting the coated backing in the absence of an electrostatic field being present and continued vibratory feeding of the abrasive particles. The angle θ from vertical can be between about 10 degrees to about 135 degrees, or between about 20 degrees, to about 90 degrees, or about 20 degrees to about 45 degrees. In other embodiments, the wrap angle about the conductive member, such as an idler roll, can range from 0 degrees to 180 degrees such that the web could travel substantially horizontally to and away from the conductive member 62 in FIG. 1 if the coated web wrapped the conductive member 62 by an amount of 180 degrees.

The inventors have surprisingly found the z-direction rotational orientation of formed abrasive particles or other particles in the coated abrasive article can be manipulated by the new electrostatic system. In particular, the feeding surface, such as the outlet trough 60, can orient a substantially planar particle surface 57 or three points on the particle forming an imaginary plane with a specific z-direction rotational orientation. Thereafter, unlike the conventional system, the particle needs to be only translated linearly through the gap 64 without any further rotation of the particle prior to attaching the particle to the coated backing. As such, it is possible to apply the particle to the coated backing while substantially maintaining the z-direction rotational orientation of the particle that was established when the particle was supported by the feeding surface. It is similar to rapidly sliding a coin off the surface of a table top into the air. The quarter tends to fly through the air without rotating about the z-axis and impacts the floor with one of its planar faces facing up.

Thus, at least 30, 40, 50, 60, 70, 80, 90, or 95 percent of the particles can attach to the coated backing having substantially the same z-direction rotational orientation that they had while resting on the feeding surface, or the same orientation relative to the backing, after attachment to the backing, as the backing traverses through the gap just prior to the particles leaving the feeding surface. In the conventional system, the z-direction rotational orientation of the particle is uncontrolled and random. Whatever edge, side, or point of the particle that is most strongly attracted by the electrostatic field while the particle rests horizontally on the conveyor will be first lifted off of the conveyor, thereby rotating the particle 90 degrees into a vertical orientation. This "lift-off" rotation is uncontrolled and results in a random orientation of the particle relative to the backing once the particle attaches to the make layer. As such, in the new system, the particles can be translated in a non-vertical direction by the electrostatic field to control the z-direction rotation of the particles prior to attaching them to the backing.

In one embodiment, when applying particles having at least one substantially planar particle surface, or having three points defining an imaginary planar surface, the particles are allowed to settle on the feeding surface into one or more layers such that the substantially planar particle surface is parallel to the feeding surface. In some embodiments, this settling is accomplished under the force of gravity during vibration of the feeding surface. This pre-orients the substantially planar particle surface relative to the backing in a predetermined orientation. If the particles on the feeding surface are applied to the feeding surface too quickly, a large mass of particles can be present which does not allow the substantially planar particle surface to rotate into the desired orientation during the settling. Thus, in specific embodiments, the particles on the feeding surface can comprise less than or equal to 5, 4, 3, 2, or 1 layer. In some embodiments, the particles on the feeding surface form a substantially monolayer of particles.

Additionally, the vibration of the feeding surface can be controlled to enhance or retain the pre-oriented position of the substantially planar particle surface. In particular, the vibration amplitude or frequency should not be too large such that the particles on the feeding surface are repeatedly launched from that surface spinning into the air, and thereafter landing on the feeding surface with a different z-direction rotational orientation. Instead, it is desirable for the particles to vibrate gently along the feeding surface translating linearly with a minimum of hopping and skipping on the feeding surface. As such, in some embodiments, the feeding surface may be angled such that the particles tend to slide along the feeding surface under the force of gravity prior to being applied to the make layer.

The inventors have surprisingly found the z-direction rotational orientation of formed abrasive particles or other particles in the coated abrasive article can be varied by changing the gap 64 between the end of the feeding tray and the conductive member. Thus, the pre-selected, z-direction rotational orientation of the particle resting on the feeding surface can be further altered by changing the gap. In particular, the gap in the new electrostatic system can be changed to cause additional z-direction rotation of the particle as it is translated by the electrostatic field through the air. When the gap, D, is less than ⅜", triangular shaped abrasive particles comprising triangular plates tend to orientate more frequently with the triangle's base and the substantially planar particle surface originally in contact with the feeding surface aligned in the machine direction of the coated backing as it traverses past the feeding tray as shown in FIG. 1 (translation of the particle plus approximately 90 degrees of rotation as the particle traverses the gap). When the gap is greater than ⅜", triangular shaped abrasive particles tend to orientate more frequently with the triangle's base and the substantially planar particle surface originally in contact with the feeding surface aligned in the cross machine direction of the coated backing as it traverses past the feeding tray (translation with minimal further rotation of the particle as it traverses the gap).

Thus, with the new electrostatic system, the gap 64 is varied to change the particle's z-direction rotational orientation. In particular, reducing the gap has been shown to align more shaped abrasive particles comprising plates in the machine direction and increasing the gap has been shown to align more of the plates in the cross machine direction. Rotational orientation of shaped abrasive particles about their z-axis passing through the coated backing can be used to enhance grinding rates, reduce abrasive particle breakage, or improve the resulting finish of the coated abrasive article. Conventional electrostatic systems are unable to control the rotational orientation of shaped abrasive particles.

In various embodiments of the invention, equal to or greater than 20, 30, 40, 50, 60, 70, 80, 90, or 95% of the particles attached to the backing by the make layer can have a pre-selected, z-direction rotational orientation relative to the backing. If a formed abrasive particle has a substantially planar particle surface, the substantially planar particle surface in the conventional system would randomly orient with respect to the backing. In various embodiments of the invention, equal to or greater than 20, 30, 40, 50, 60, 70, 80, 90, or 95% of the formed abrasive particles attached to the backing by the make layer have a pre-selected, z-direction rotational orientation relative to the backing such as having the substantially planar particle surface aligned in either the machine direction or the cross machine direction.

The new electrostatic system can also control the z-direction rotational orientation of shaped abrasive particles 56 or other particles by use of profiled feeding trays or turning bars. Referring now to FIG. 2, in top plan view, a coated backing 32 is conveyed along a web path 22 towards a turning bar 68 having a curved outer surface acting as a conductive member 62. The coated backing 32 wraps the turning bar 68 approximately 180 degrees and the turning bar is angled at 45 degrees to the incoming web path. As such, the coated backing is redirected orthogonal to the incoming web path 22. Abrasive particles 56 comprising shaped abrasive particles of thin triangular plates are fed by vibration and translated by electrostatic attraction from the outlet trough 60 of the vibratory feeder 36 and become attached to the coated backing 32 as it wraps the turning bar. Since the coated backing 32 is now at a 45 degree angle as the abrasive particles are applied, the shaped abrasive particles are attached to the coated backing rotated 45 degrees from the orientation achieved by the electrostatic system of FIG. 1. Further rotational orientation to either add to or subtract from the built-in 45 degree rotation provided by the turning bar 68 can be achieved by varying the gap 64 between the outlet trough 60 and turning bar.

Figure 3A:
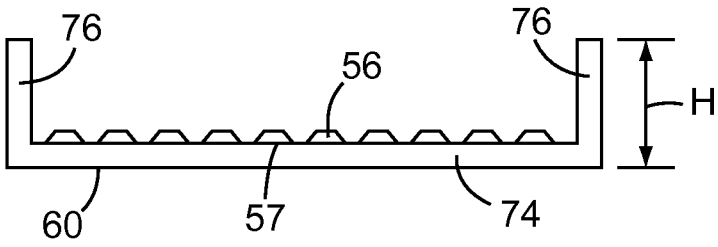
FIGS. 3A, 3B, 3C are cross sections of different feeding trays taken at 3-3 in FIG. 1.
Figure 3B:
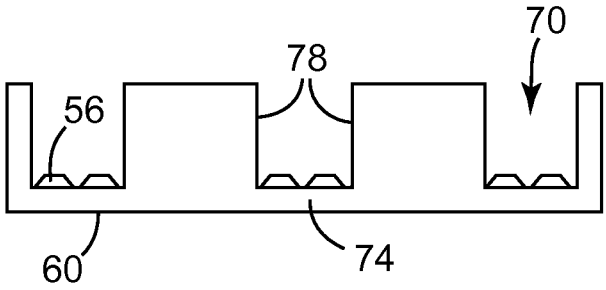
Figure 3C:
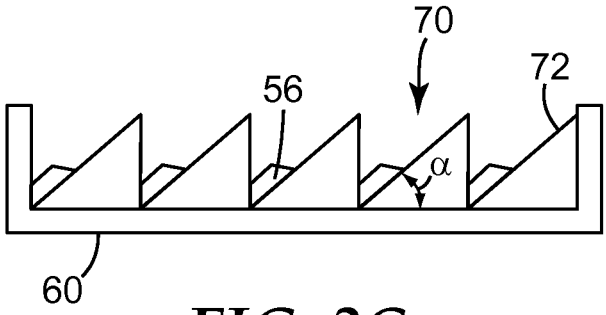

Referring to FIG. 3C, a cross section of one embodiment of the outlet trough 60 is shown taken at 3-3 of FIG. 1. The outlet trough 60 comprises a plurality of discrete channels 70 each having a CD sloped, planar support surface 72 intersecting with the horizontal base of the outlet trough at an angle α. The CD sloped, planar support surfaces are angled such that the particles tend to slide down the support surface in the cross machine direction under the force of gravity. When shaped abrasive particles 56 comprising triangular plates are present in the outlet trough 60, they tend to rest flat on the sloped support surfaces 72 on one of their substantially planar particle surfaces. One example of shaped abrasive particles comprising triangular plates and having a sloping sidewall (truncated triangular pyramids) are shown and described in U.S. patent publication 2010/0151196 published on Jun. 17, 2010 as seen in FIGS. 1 and 2 of that publication. If the CD sloped, planar support surface is sloped at an angle α of, for example 30 degrees, the shaped abrasive particles that are applied to the coated backing tend to be rotated 30 degrees from the orientation achieved by the outlet trough 60 shown in FIG. 3A in the absence of further rotation provided by varying the gap 64. The angle α of the CD sloped planar support surface can vary between 1 to 89 degrees or between 20 to 70 degrees such as 30, 45, or 60 degrees.

Figure 12:
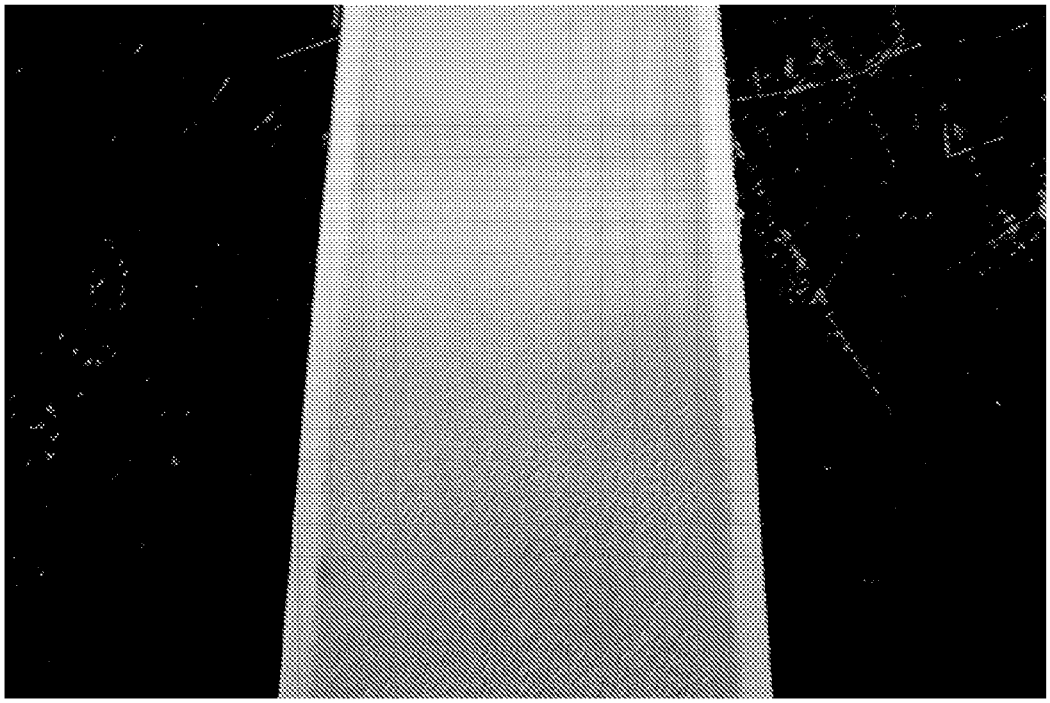
Figure 13:
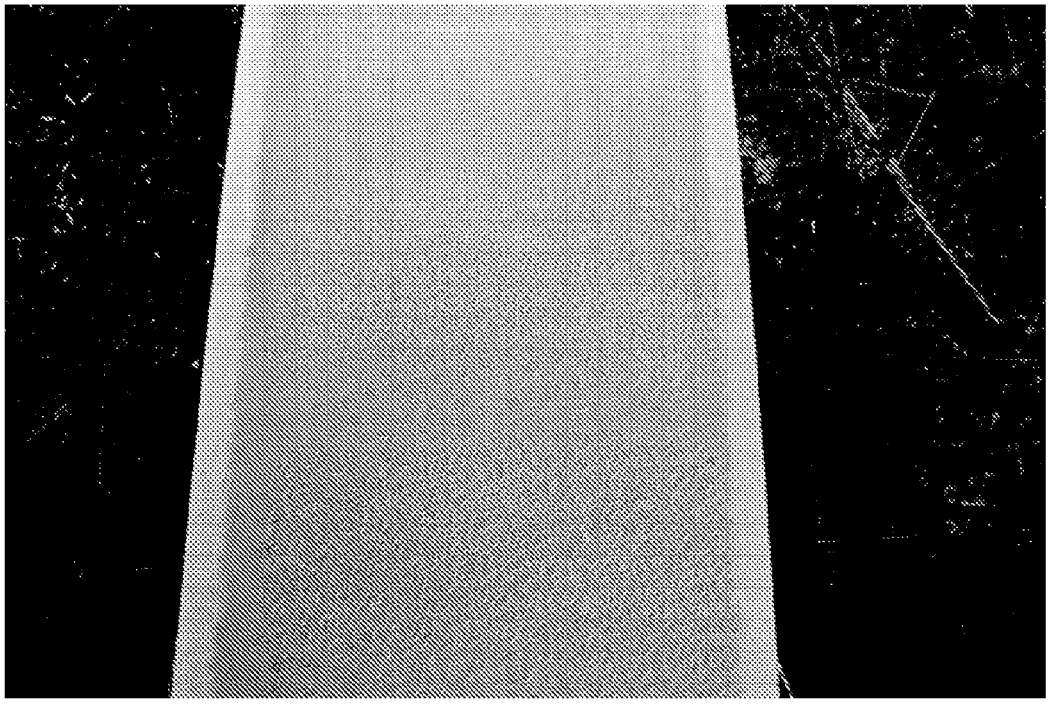
Figure 14:
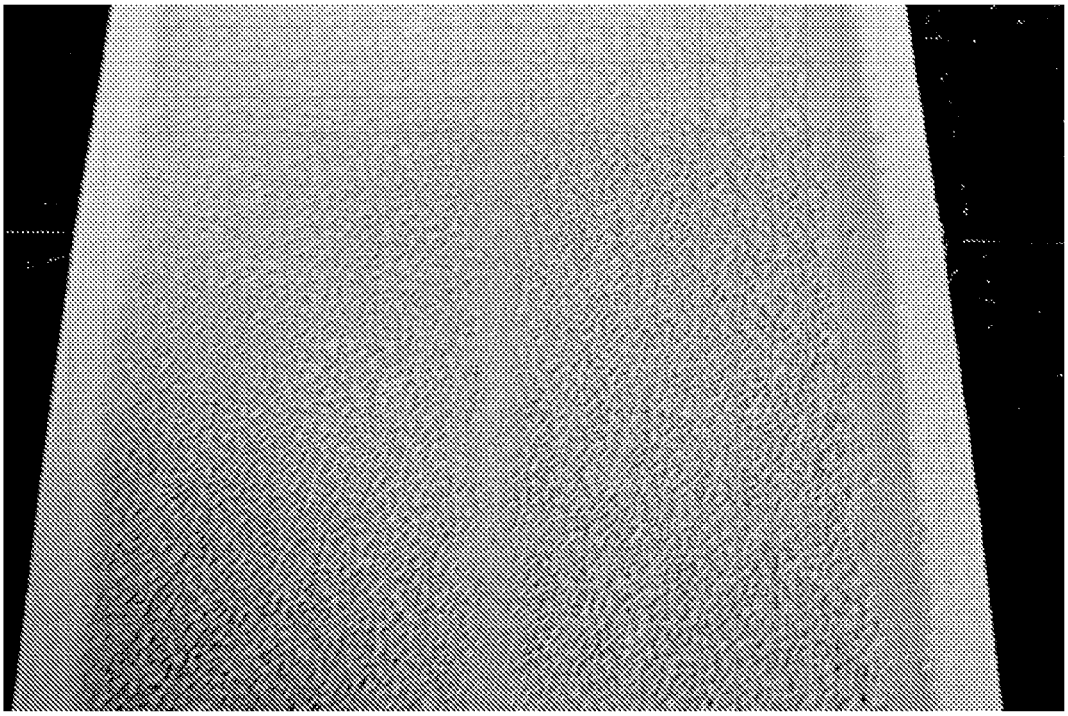

As mentioned, the new electrostatic system has the ability to create patterned abrasive layers as shown in FIGS. 10-15. The patterns can be created by varying the feeding surface of the outlet trough 60 or changing the application method. In particular, the abrasive grain can be applied in cross machine direction stripes by cycling the voltage applied to the electrostatic field (FIGS. 12, 13), the vibratory feeder (FIGS. 10, 11), or both. When the outlet trough 60 comprises a plurality of spaced apart, discrete channels 70 each having a horizontal planar support surface 74 connected to opposing vertical walls 78 (FIG. 3B), machine direction stripes of abrasive grain can be applied (FIG. 14, 15). Thereafter, cycling the voltage applied to the electrostatic field, the vibratory feeder, or both when using the outlet trough of FIG. 3B could result in a checker-board pattern of the abrasive grain on the coated backing (combination of FIGS. 11 and 15). As previously discussed, a CD sloped, planar support surface as shown in FIG. 3C can be used to z-direction rotate shaped abrasive particles prior to application onto the coated backing. Combinations of the foregoing are possible.

It is also possible to apply lines, curves or other patterns by attaching the outlet trough or the entire vibratory feeder to a positioning mechanism to direct a moving stream of abrasive particles in the X, Y, or Z direction or combinations thereof. Suitable positioning mechanisms include linear actuators, servo hydraulic actuators, ball screw actuators, pneumatic actuators, and other positioning mechanisms known to those of skill in the art. In addition to the above outlet trough designs, the outlet trough 60 and feeding surface can be U-shaped, V-shaped, half round, tubular, or other profile to support the particles within the outlet trough prior to propelling the particles though the gap into the make coat.

In various embodiments of the invention, the feeding surface and the backing as it traverses through the gap are arranged in a non-parallel manner. In other embodiments, the feeding surface in a feeding direction is substantially orthogonal to the backing positioned in the gap between the feeding surface and a conductive member. In yet other embodiments, the feeding surface is substantially horizontal and the backing is substantially vertical at the gap. In the various embodiments, the particles are translated from the feeding surface to the backing in a non-vertical direction. Additionally, in various embodiments, the backing is traveling upwards against the force of gravity as it traverses past the feeding surface. In some embodiments, the backing is traveling substantially vertically upwards past the feeding surface. It is believed that this direction of travel results in more particles having an erect orientation with respect to the backing. For example, as a particle free falls off of the feeding surface its leading edge can be lower than the trailing edge of the particle beginning to leave the surface due to gravity. Catching this leading edge in the make layer and translating it upwards against the force of gravity can assist in achieving an erect orientation and reducing the tilt of the particles relative to the backing.

Abrasive particles suitable for use with the electrostatic system include any known abrasive particle and the electrostatic system is especially effective for applying formed abrasive particles. Suitable abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, ceramic alpha alumina sol-gel derived abrasive particles, and blends thereof. The abrasive particles may be in the form of, for example, individual particles, agglomerates, abrasive composite particles, and mixtures thereof.

Referring now to FIG. 1, exemplary shaped abrasive particles 56 are shown. The shaped abrasive particles are molded into a generally triangular shape during manufacturing and comprise plates having two opposed substantially planar particle surfaces and a triangular perimeter. In specific embodiments, the shaped abrasive particles can comprise triangular prisms (90 degree or straight edges) or truncated triangular pyramids with sloping sidewalls. In many embodiments, the faces of the shaped abrasive particles comprise equilateral triangles. Suitable shaped abrasive particles and methods of making them are disclosed in the following patent application publications: US 2009/0169816; US 2009/0165394; US 2010/0151195; US 2010/0151201; US 2010/0146867; and US 2010/0151196.

The abrasive particles are typically selected to correspond to abrasives' industry accepted nominal grades such as, for example, the American National Standards Institute, Inc. (ANSI) standards, Federation of European Producers of Abrasive Products (FEPA) standards, and Japanese Industrial Standard (JIS) standards. Exemplary ANSI grade designations (i.e., specified nominal grades) include: ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600. Exemplary FEPA grade designations include: P8, P12, P16, P24, P36, P40, P50, P60, P80, P100, P120, P180, P220, P320, P400, P500, 600, P800, P1000, and P1200. Exemplary JIS grade designations include: JIS8, JIS12, JIS16, JIS24, JIS36, JIS46, JIS54, JIS60, JIS80, JIS100, JIS150, JIS180, JIS220, JIS240, JIS280, JIS320, JIS360, JIS400, JIS400, JIS600, JIS800, JIS1000, JIS1500, JIS2500, JIS4000, JIS6000, JIS8000, and JIS10,000.

The new electrostatic system can also be used to apply filler particles to the coated backing. Useful filler particles include silica such as quartz, glass beads, glass bubbles and glass fibers; silicates such as talc, clays (e.g., montmorillonite), feldspar, mica, calcium silicate, calcium metasilicate, sodium aluminosilicate, sodium silicate; metal sulfates such as calcium sulfate, barium sulfate, sodium sulfate, aluminum sodium sulfate, aluminum sulfate; gypsum; vermiculite; wood flour; aluminum trihydrate; carbon black; aluminum oxide; titanium dioxide; cryolite; chiolite; and metal sulfites such as calcium sulfite.

The new electrostatic system can be used to apply grinding aid particles to the coated backing. Exemplary grinding aids, which may be organic or inorganic, include waxes, halogenated organic compounds such as chlorinated waxes like tetrachloronaphthalene, pentachloronaphthalene, and polyvinyl chloride; halide salts such as sodium chloride, potassium cryolite, sodium cryolite, ammonium cryolite, potassium tetrafluoroborate, sodium tetrafluoroborate, silicon fluorides, potassium chloride, magnesium chloride; and metals and their alloys such as tin, lead, bismuth, cobalt, antimony, cadmium, iron, and titanium; and the like. Examples of other grinding aids include sulfur, organic sulfur compounds, graphite, and metallic sulfides. A combination of different grinding aids can be used. The grinding aid may be formed into particles or particles having a specific shape as disclosed in U.S. Pat. No. 6,475,253.

Suitable backings 20 to apply the abrasive particles to include those known in the art for making coated abrasive articles. Typically, the backing has two opposed major surfaces. The thickness of the backing generally ranges from about 0.02 to about 5 millimeters, from about 0.05 to about 2.5 millimeters, or from about 0.1 to about 0.4 millimeter, although thicknesses outside of these ranges may also be useful. Exemplary backings include nonwoven fabrics (e.g., including needletacked, meltspun, spunbonded, hydroentangled, or meltblown nonwoven fabrics), knitted, stitchbonded, and woven fabrics; scrim; combinations of two or more of these materials; and treated versions thereof.

Suitable coaters 24 for use in the apparatus include any coater capable of applying a make layer onto a backing such as: knife coaters, air knife coaters, gravure coaters, reverse roll coaters, metering rod coaters, extrusion die coaters, spray coaters and dip coaters.

The make layer 28 can be formed by coating a curable make layer precursor onto a major surface of the backing. The make layer precursor may comprise, for example, glue, phenolic resin, aminoplast resin, urea-formaldehyde resin, melamine-formaldehyde resin, urethane resin, free-radically polymerizable polyfunctional (meth)acrylate (e.g., aminoplast resin having pendant alpha, beta-unsaturated groups, acrylated urethane, acrylated epoxy, acrylated isocyanurate), epoxy resin (including bis-maleimide and fluorene-modified epoxy resins), isocyanurate resin, and mixtures thereof.

Figure 4:
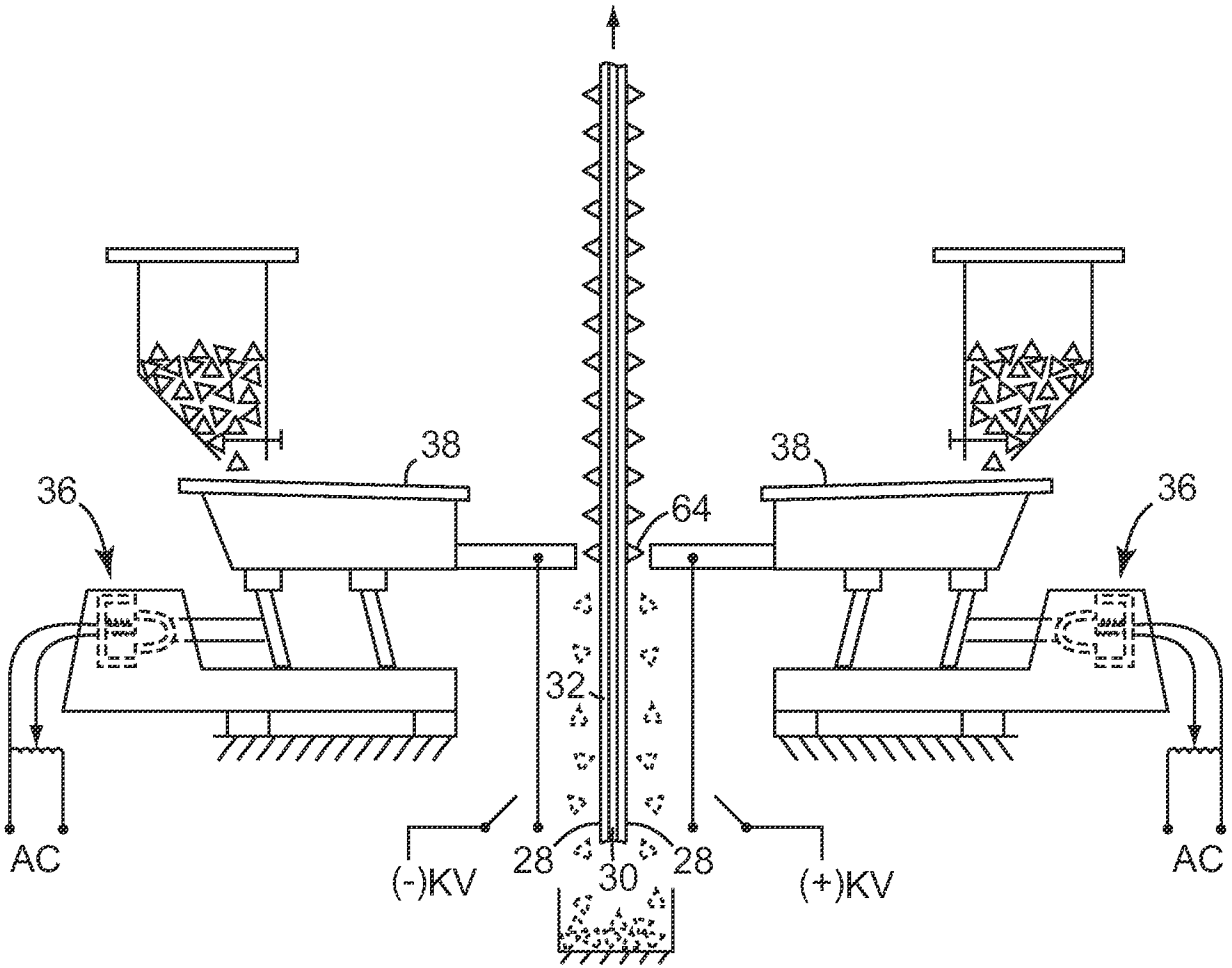
FIG. 4 illustrates another embodiment of the electrostatic system for simultaneously applying abrasive particles to both sides of a coated backing.

Referring now to FIG. 4, an alternative embodiment of the electrostatic coating system is shown. Simultaneous double-sided particle layers may be applied by the new electrostatic method. In this method, the coated backing 20 with a make layer 28 on both of its major surfaces is traversed substantially vertically through a gap 64 between two vibratory feeders 36 each having an electrostatically charged feeding tray 38. The feeding trays of the two vibratory feeders are substantially opposed to each other; although it is believed they can be slightly offset in the machine direction in some embodiments. The first feeding surface of the first vibratory feeder is connected to a positive potential and a second feeding surface of the second vibratory feeder is connected to a negative potential. The abrasive particles on each feeding surface are propelled towards the opposing feeding surface and attach to opposites sides of the coated backing.

Figure 5:
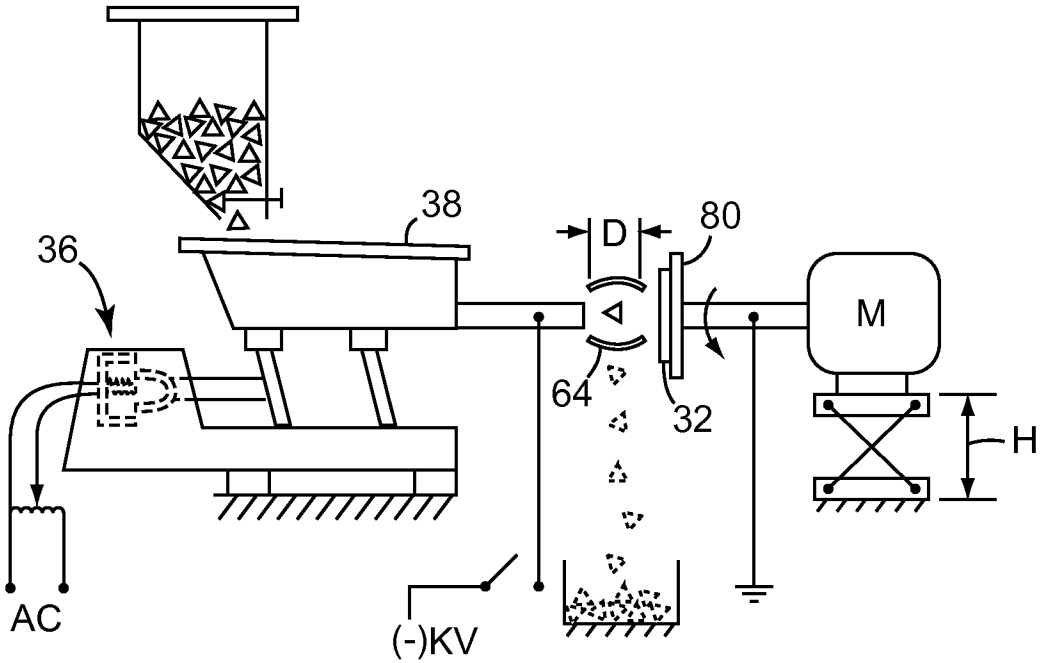
FIG. 5 illustrates another embodiment of the electrostatic system for applying abrasive particles to a rotating coated backing.

Referring now to FIG. 5, another alternative embodiment of the electrostatic coating system is shown A coated backing can be attached to a planar circular surface of a rotating circular disk 80 located near the discharge of the electrostatically charged feeding tray 38 of a vibratory feeder 36. At least a portion of the feeding tray is charged and the disk is grounded to create an electrostatic field. The gap 64 between the coated backing on the rotating circular disk and the feeding tray, along with the rotational velocity of the disk, can be changed to vary the z-direction rotation of shaped abrasive particles applied to the coated backing. In particular to assure more of the particles are applied erectly, the rotating circular disk should rotate such that the backing translates substantially vertically upwards past the feeding surface as the particles translate the gap. In some embodiments, the width of the feeding surface can be equal to or less than the radius of the disc such that formed abrasive particles are applied to only a portion of the diameter of the disc without the disc rotating.

EXAMPLES

Objects and advantages of this invention are further illustrated by the following non-limiting examples; however, the particular materials and amounts thereof recited in these examples, as well as other conditions and details, should not be construed to unduly limit this invention. Unless otherwise noted, all parts, percentages, ratios, etc. in the Examples and the rest of the specification are by weight.

Examples 1-5

Examples 1-5 demonstrate various embodiments of the invention. For all examples, a standard phenolic make layer coating and a standard backing were used. For all examples, an open coat of shaped abrasive particles comprising triangular plates were projected onto the make coated backing. The shaped abrasive particles were prepared according to the disclosure of U.S. patent publication 2010/0151196. The shaped particles were prepared by shaping alumina sol gel from equilateral, triangular-shaped polypropylene mold cavities of side length 0.054 inch (1.37 mm) and a mold depth of 0.012 inch (0.3 mm). After drying and firing, the resulting shaped abrasive particles were about 570 micrometers (longest dimension) and would pass through a 30-mesh sieve. Machine settings for the electrostatic coating apparatus were: line speed of 12.5 ft/min (3.81 m/min); vibratory feeder setting of 200-350 ("SYNTRON Model FT01", FMC Technologies, Houston, Tex.); applied potential of 5 kv±1 kv; gap between outlet trough and conductive member ground bar of 0.375 inch±0.125 inch (0.95±0.32 cm); the bottom edge of the outlet trough aligned to the center of the ground bar; and the ground bar diameter was 0.375 inch (0.95 cm). Secondary particles, when applied, were grade 80 crushed alumina particles. Various changes in the machine settings were made to generate the exemplary embodiments of Examples 1-5 as shown in Table 1, below.

TABLE 1

Figure 6:
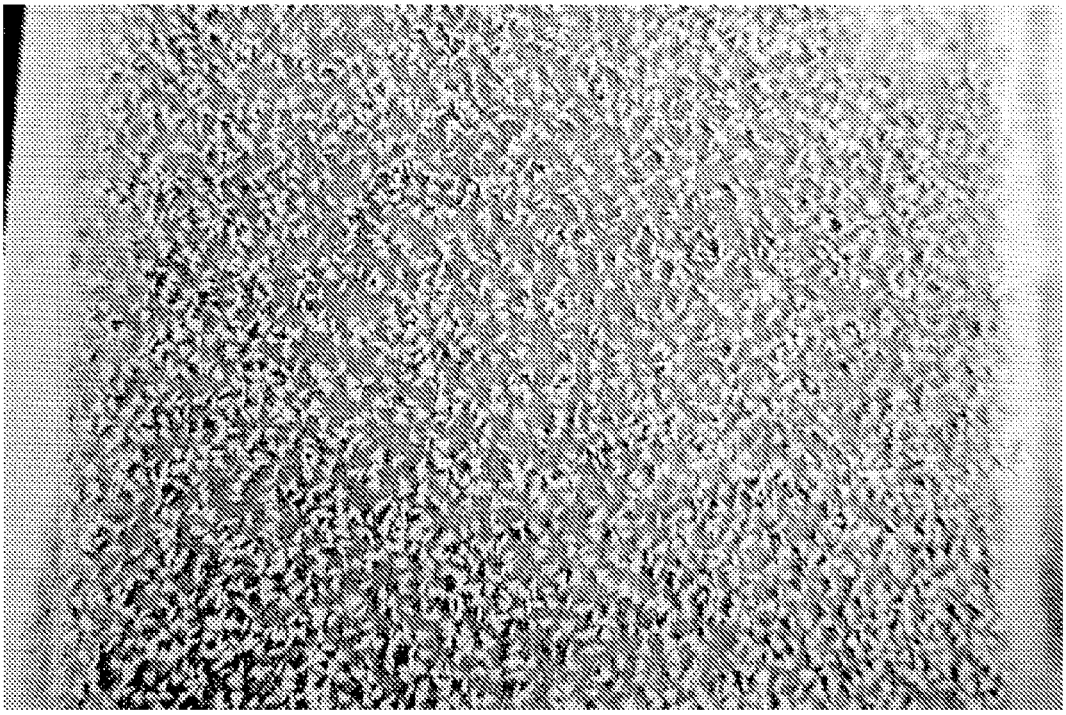
FIGS. 6-15 are photographs of the abrasive layer of various coated abrasive articles made as discussed in the Examples.
Figure 7:
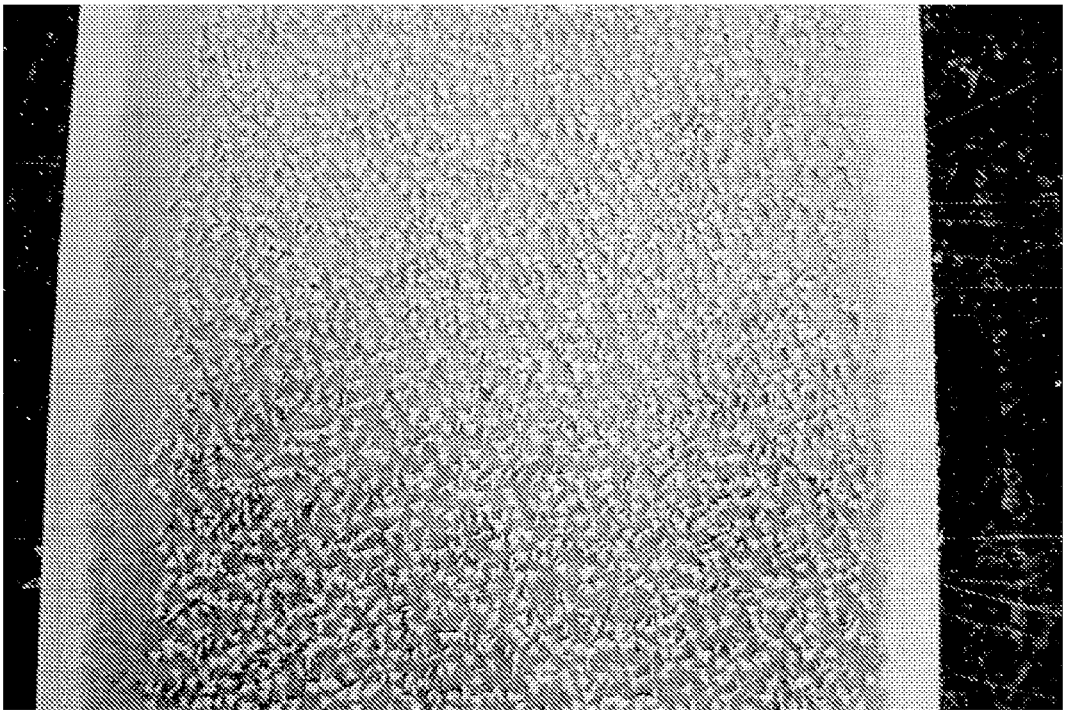
Figure 8:
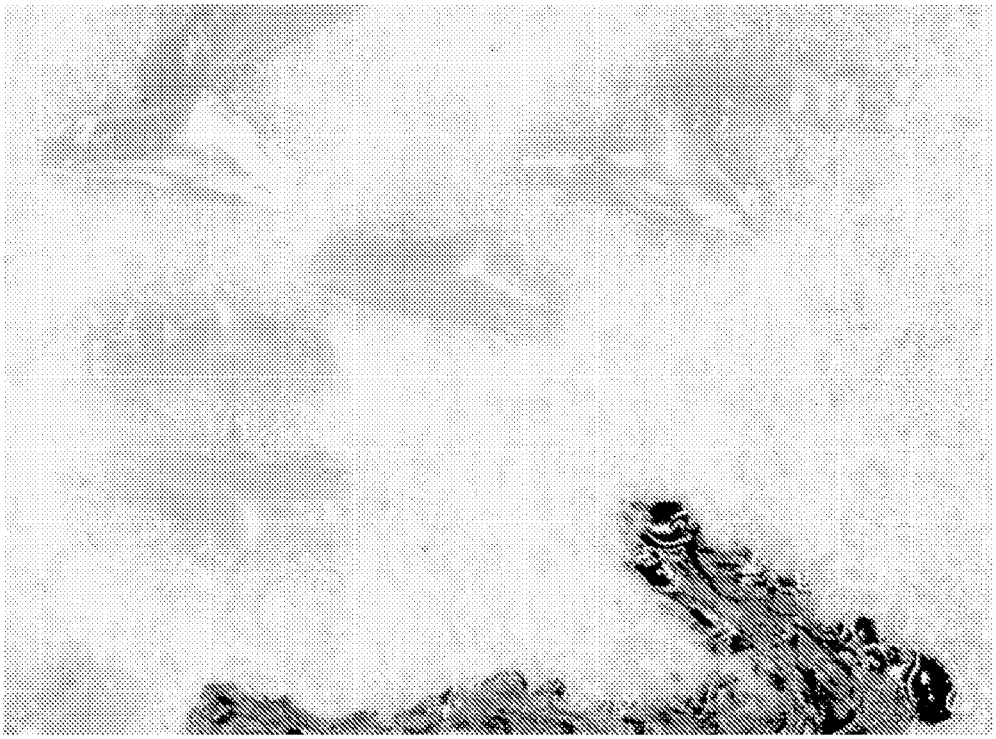
Figure 9:
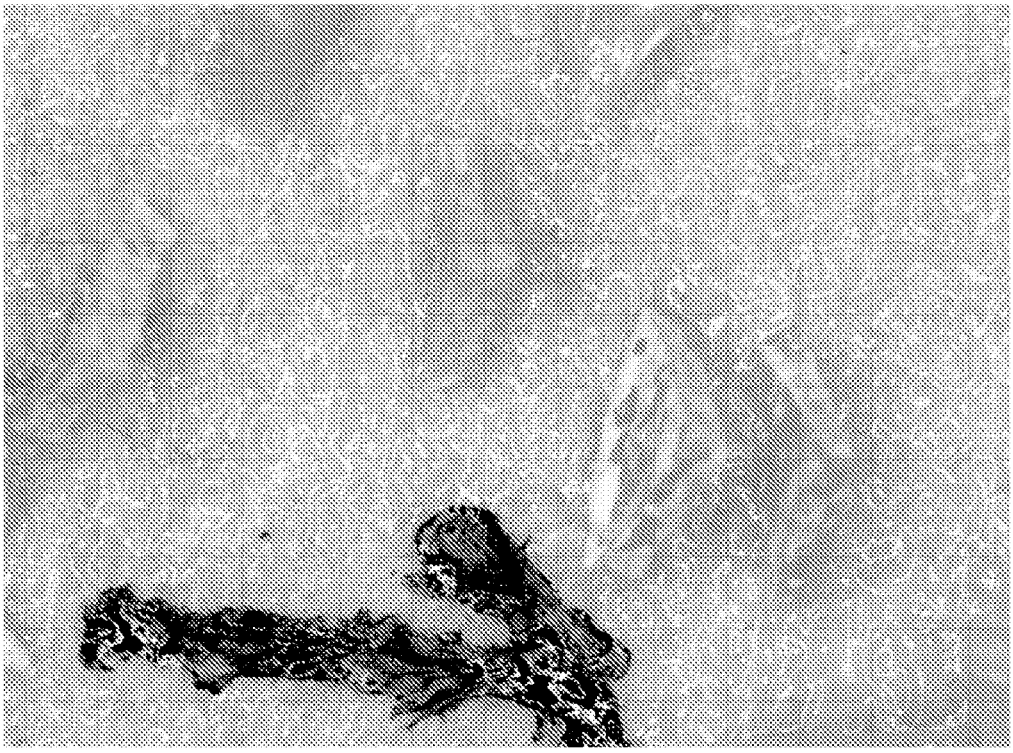

| Example | Modification to create effect | Result |
|---|---|---|
| 1 | Drop coated with secondary crushed abrasive particle after electrostatic coating shaped abrasive particle | FIGS. 6, 7 |
| 2 | Make gap less than ⅜"(9.52 mm) to align shaped abrasive particles substantially horizontally (parallel) to the machine direction (black arrow machine direction) | FIG. 8 |
| 3 | Make gap greater than ⅜" (9.52 mm) to align shaped abrasive particles substantially orthogonal to the machine direction (black arrow machine direction) | FIG. 9 |

TABLE 1-continued

Figure 10:
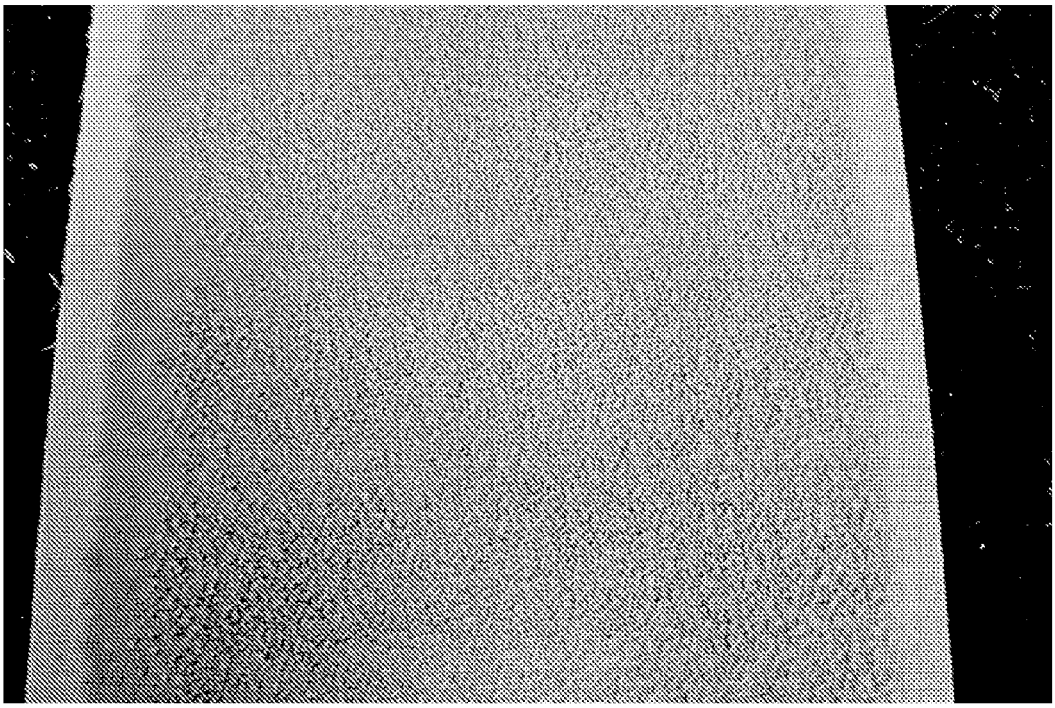
Figure 11:
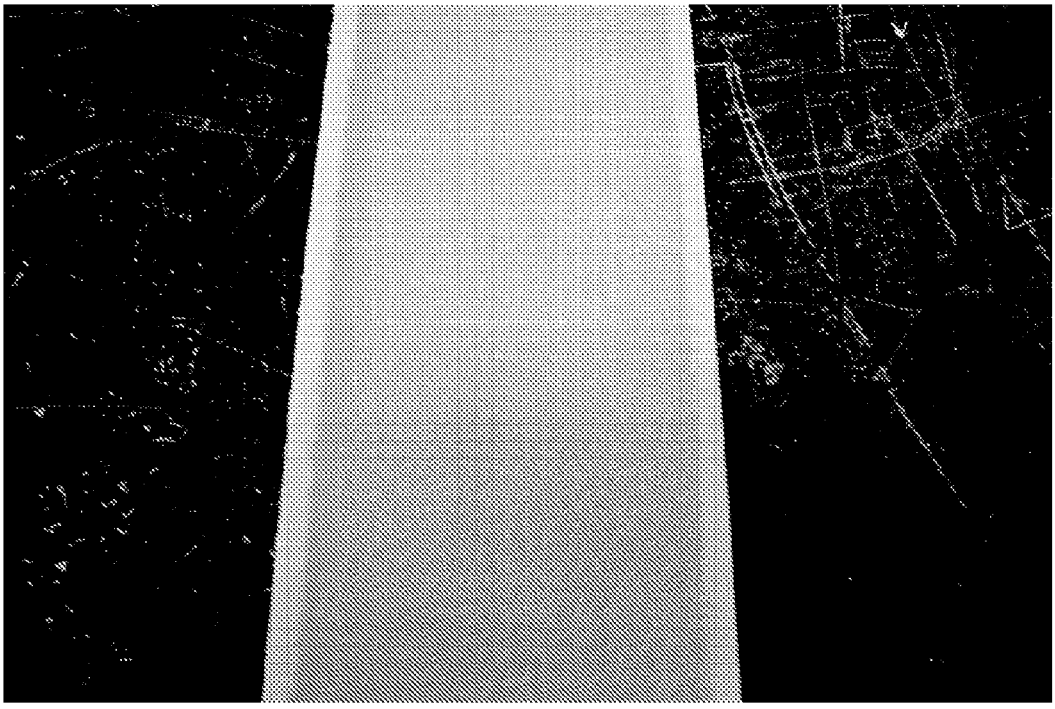
Figure 15:
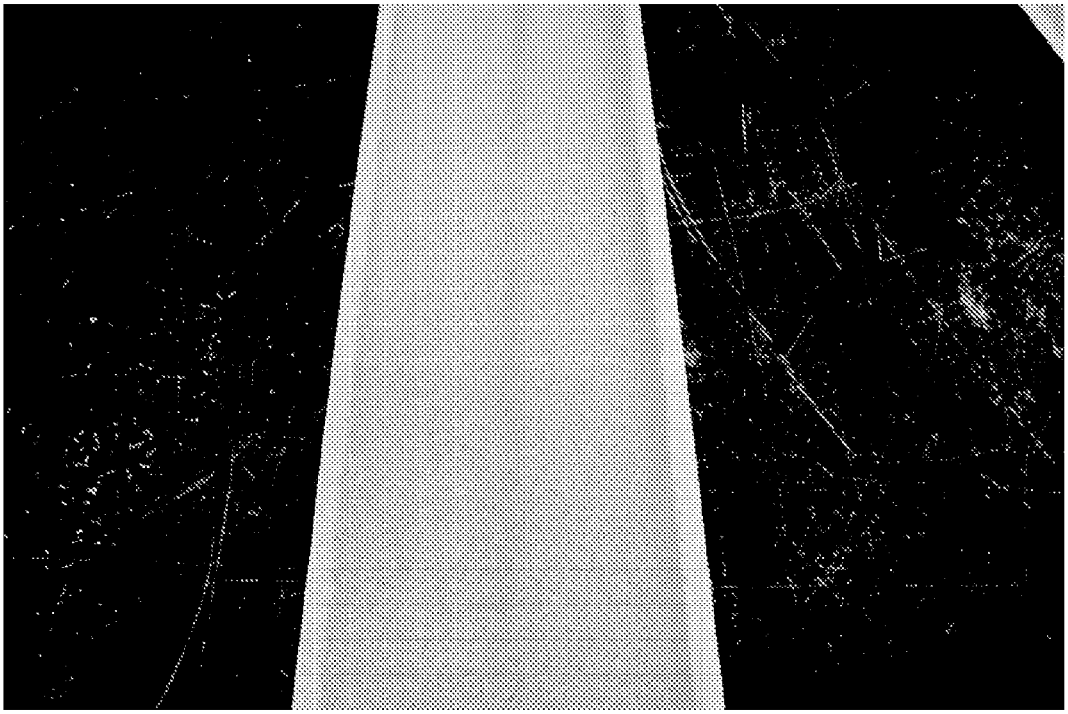

| Example | Modification to create effect | Result |
|---|---|---|
| 4 | Vibratory feeder was pulsed on/off to create cross web abrasive stripes | FIGS. 10, 11 |
| 5 | Electrostatic potential being applied was pulsed on/off to create cross web abrasive stripes | FIGS. 12, 13 |
| 6 | Strip of film was mounted linearly on outlet trough to create discrete channels and create machine direction abrasive stripes | FIGS. 14, 15 |

Other modifications and variations to the present disclosure may be practiced by those of ordinary skill in the art, without departing from the spirit and scope of the present disclosure, which is more particularly set forth in the appended claims. It is understood that aspects of the various embodiments may be interchanged in whole or part or combined with other aspects of the various embodiments. All cited references, patents, or patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What claimed is:

1. A method of applying particles to a backing having a make layer on one of the backing's opposed major surfaces comprising:

supporting the particles on a feeding member having a feeding surface comprising a conductive material such that the particles settle into one or more layers on the feeding surface;

the feeding surface and the backing being arranged in a non-parallel manner; and translating the particles from the feeding surface to the backing by an electrostatic force and attaching the particles to the make layer.

2. The method of claim 1 wherein the feeding surface comprises at least one planar surface.

3. The method of claim 1 wherein the electrostatic force is generated by charging the feeding surface from a voltage potential creating an electrostatic field between the feeding surface and a conductive member located on an opposite side of the backing from the make layer.

4. The method of claim 3 wherein the conductive member comprises a curved outer surface and the backing wraps at least a portion of the curved outer surface.

5. The method of claim 4 wherein the conductive member is selected from the group consisting of a turning bar, an idler roll, a spreader bar, and a round rod.

6. The method of claim 3 wherein the conductive member comprises a rotating circular disk having a planar circular surface facing the feeding surface and the backing is attached to the planar circular surface with the make layer facing the feeding surface.

7. The method of claim 3 wherein the conductive member comprises a second feeding surface, the backing comprises a make layer on both of its opposed major surfaces, and the particles are translated from the feeding surface and from the second feeding surface onto the make layer on both major surfaces of the backing.

8. The method of claim 3 comprising varying a z-direction rotational orientation of the particles attached to the make layer by adjusting a gap between the feeding surface and the conductive member.

9. The method of claim 8 wherein the particles comprise at least one substantially planar particle surface, the substantially planar particle surface parallel to the feeding surface and the particles are translated without further z-direction rotation of the substantially planar particle surface by the electrostatic field before attaching the particles to the make layer.

10. The method of claim 8 wherein the particles comprise at least one substantially planar particle surface, the substantially planar particle surface parallel to the feeding surface and the particles are translated with further z-direction rotation of the substantially planar particle surface by the electrostatic field before attaching the particles to the make layer.

11. The method of claim 1 wherein the particles settle under the force of gravity.

12. The method of claim 1, wherein the feeding member comprises a vibratory feeder and the feeding surface comprises an outlet trough.

13. The method of claim 12 wherein the outlet trough comprises a planar base connected to opposing sidewalls.

14. The method of claim 12 wherein the outlet trough comprises a plurality of spaced apart discrete channels each having a planar base connected to opposing sidewalls.

15. The method of claim 12 wherein the outlet trough comprises a plurality of spaced apart discrete channels each having a cross machine direction sloped, planar support surface intersecting with a base of the outlet trough.

16. The method of claim 1, wherein the particles comprise a monolayer on the feeding surface.

17. The method of claim 1, wherein the feeding surface in a feeding direction is substantially orthogonal to the backing positioned in a gap between the feeding surface and a conductive member.

18. The method of claim 17 wherein the feeding surface in the feeding direction is substantially horizontal and the backing is substantially vertical.

19. The method of claim 3, wherein the feeding member comprises a vibratory feeder and the feeding surface comprises an outlet trough.

20. The method of claim 1 wherein the backing is substantially vertical.

21. The method of claim 20 wherein the backing is positioned in a gap between the feeding surface and a conductive member and the particles are propelled horizontally across the gap onto the make layer by the electrostatic force.

22. The method of claim 1 wherein the particles are translated substantially horizontally from the feeding surface to the backing by the electrostatic force.

* * * * *

UNITED STATES PATENT AND TRADEMARK OFFICE

CERTIFICATE OF CORRECTION

PATENT NO. : 8,771,801 B2
APPLICATION NO. : 13/883132
DATED : July 8, 2014
INVENTOR(S) : Louis Moren It is certified that error appears in the above-identified patent and that said Letters Patent is hereby corrected as shown below:

In the Specification:

Column 1
Line 38, delete "backing" and insert -- backing. --, therefor.
Line 49, delete "backing" and insert -- backing. --, therefor.

Column 3
Lines 20-21, delete "backing" and insert -- backing. --, therefor.
Line 48, delete "backing" and insert -- backing. --, therefor.

Column 10
Line 55, delete "600," and insert -- P600, --, therefor.

Signed and Sealed this
Twenty-fifth Day of November, 2014

Michelle K. Lee

Michelle K. Lee
*Deputy Director of the United States Patent and Trademark Office*